United States Patent [19]

Luthi

[11] 4,085,003

[45] Apr. 18, 1978

[54] PRESSURE PULP WASHER WITH PIVOTED BAFFLE

[75] Inventor: Oscar Luthi, Nashua, N.H.

[73] Assignee: Ingersoll-Rand Company, Woodcliff Lake, N.J.

[21] Appl. No.: 779,146

[22] Filed: Mar. 18, 1977

[51] Int. Cl.[2] ..... D21F 1/04; D21F 1/60

[52] U.S. Cl. ..... 162/259; 68/43; 100/121; 162/317; 162/329

[58] Field of Search ..... 162/60, 210, 214, 252, 162/289, 311, 317, 327, 328, 329, 259; 8/156; 68/43; 100/121; 210/402

[56] References Cited

U.S. PATENT DOCUMENTS

| | | | |
|---|---|---|---|
| 2,402,063 | 6/1946 | Malkin | 162/328 X |
| 3,772,144 | 11/1973 | Luthi et al. | 162/329 X |

*Primary Examiner*—Richard V. Fisher

*Attorney, Agent, or Firm*—Frank S. Troidl

[57] ABSTRACT

At least one longitudinal baffle extends from an area within the forming zone into the compaction zone. In the forming zone the baffle is pivotally connected to the vat and also has a pivotal structure in the area where the forming zone changes into the compaction zone. Actuating means are located in the compaction zone and apply actuating forces against the outside surface of the baffle to cause the baffle to automatically adjust the convergence angle in response to changes in pulp mat thickness.

3 Claims, 5 Drawing Figures

PRESSURE PULP WASHER WITH PIVOTED BAFFLE

This invention relates to pulp and paper technology. More particularly, this invention is a new and improved pressure pulp washer.

In a currently used method of making pulp from wood stock, the wood, which may be in the form of wood chips, is heated in a digester. In the digester, the lignin is chemically dissolved and heated to free the cellulose fibers so that they can be reformed into paper.

The cooked pulp fibers are then blown into a tank where the steam flashes off. Black liquor is added to the blow tank to dilute the stock in the blow tank to, say, 3½ to 4% consistency. The pulp slurry from the blow tank is then usually further diluted to 1% consistency at the washer head box for good sheet formation on the cylinder.

In the pulp washer, a pulp mat is formed from the pulp slurry and the black liquor is extracted. As the pulp slurry enters the forming zone, the differential pressure across the rotating cylinder will start the formation of the pulp mat. The formed mat then goes through the compaction zone where more of the original liquor is extracted. This further extraction of the original liquor may be caused by a compaction baffle. The purpose of the compaction baffle is to dewater the formed mat to a high consistency of, say, 15 to 20% consistency without mat disruption, in the shortest time possible. The extraction rate or the angle of convergence is very important. The angle of convergence must change with any changes in the mat thickness in order to obtain the most efficient dewatering of the formed mat and yet not disrupt or tear the mat. This invention is a baffle arrangement which automatically adjusts the angle of convergence when the mat thickness changes.

Briefly described, this invention is a pulp washer with a vat, a rotatable cylinder in the vat, a pulp inlet, and means for removing the pulp mat from the rotatable cylinder. At least one longitudinal baffle extends circumferentially from a point within the forming zone into the compaction zone. The baffle is pivotally connected to the vat at its upstream end in the forming zone. The baffle is also pivotally arranged in the area where the forming zone changes into the compaction zone. Actuating means are positioned to apply actuating forces against the outside surface of the baffle. The actuating means are properly positioned so that the baffle will automatically adjust the convergence angle in response to changes in thickness of the pulp mat.

The invention, as well as its many advantages, may be further understood by reference to the following detailed description and drawings in which.

In the various Figures, like parts are referred to by like numbers.

Figure 1:
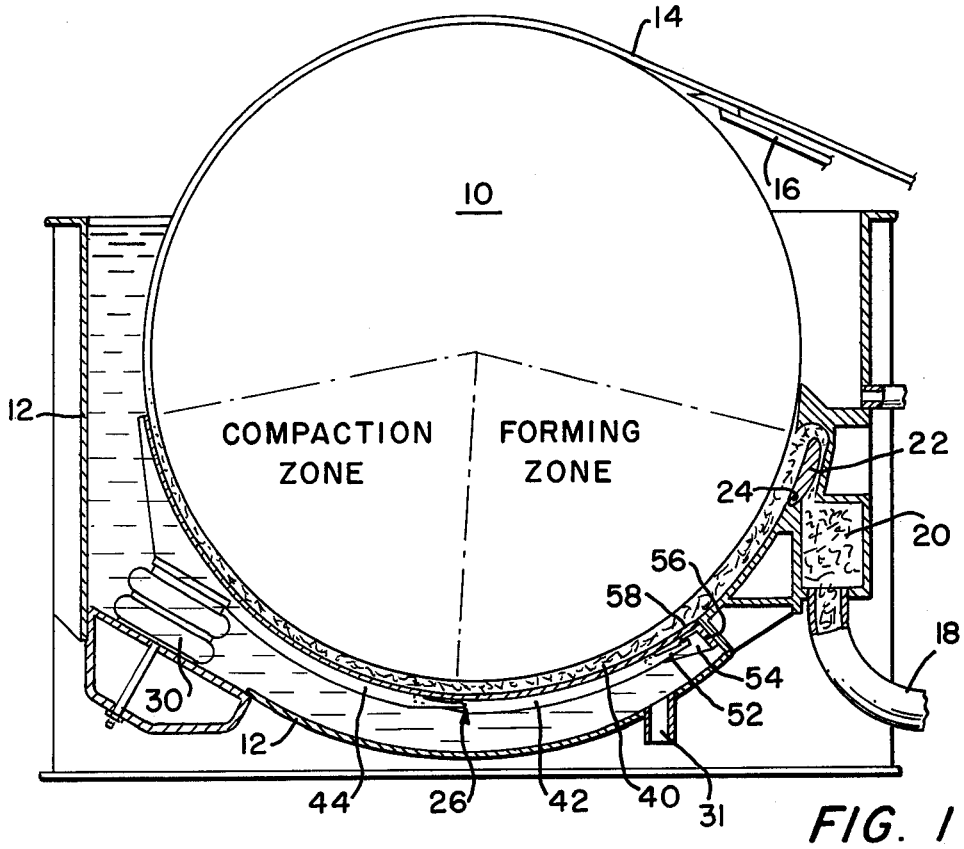
FIG. 1 is a front schematic view, partly in section, showing the new washer.

Referring to the Figures, and particularly to FIG. 1, the vacuum or pressure washer is a wire cloth covered cylinder 10 which rotates in a vat 12 containing the pulp slurry. The lower section of the drum 10 is submerged in the pulp. By means of internal valving (not shown), a vacuum or differential pressure is applied as the rotating cylinder enters the pulp slurry. The black liquor drains inwardly through the wire cloth (not shown), leaving a layer of pulp 14 on the face of the wire and the pulp layer is held there by the vacuum inside the cylinder. As the cylinder 10 continues to rotate, the thick layer of pulp adhering to the face wire emerges from the slurry. Black liquor continues to drain from the pulp as a result of the differential pressure between the external atmosphere and the vacuum within the cylinder. Finally, the vacuum is cut off and the washed pulp mat 14 is removed from the wire of the cylinder by the scraper 16 just before the cycle is repeated.

The pulp slurry, which may be as high in consistency as 4%, is fed through a pulp conduit 18 into the pulp slurry inlet box 20. The pulp slurry then flows around the pivotal member 22 which may pivot about pivot 24 and into the space between the outside periphery of rotatable cylinder 10 and the inside surface of the vat 12.

The pulp slurry begins to form the mat 14 in the forming zone. A specially constructed compacting baffle 26 mounted downstream from the pulp slurry inlet box 20 applies a compacting force against the mat being formed by means of small actuators 30 (one shown in FIG. 1). Wash water enters vat 12 through wash water inlet 31. Water showers (not shown) may also be used to apply wash water to the mat 14 just before the mat is removed by scraper 16.

The baffle consists of a thin flexible plate 40 which may extend longitudinally the full length of the cylinder 14. The thin flexible plate 40 extends circumferentially from a point within the forming zone to the end of the compaction zone. A first group of reinforcing ribs 42 and a second group of reinforcing ribs 44 are connected to the bottom of the flexible plate 40. Though the major portion of the ribs 42 and 44 are connected to the flexible plate 40, the cantilevered ends 46 and the cantilevered ends 48 on reinforcing ribs 42 and 44, respectively, are spaced from the radial outside surface of the flexible plate 40. This provides areas 50 of the flexible plate 40 which are allowed to flex and operate as a pivot in the area where the forming zone changes into the compaction zone.

Similarly, cantilevers 52 on ribs 42 and cantilevers 54 extending from the side wall 56 of the vat 12 are spaced from the thin plate 40 at the points 58 within the forming zone. Thus, areas 58 provide a second pivotal area.

Figure 2:
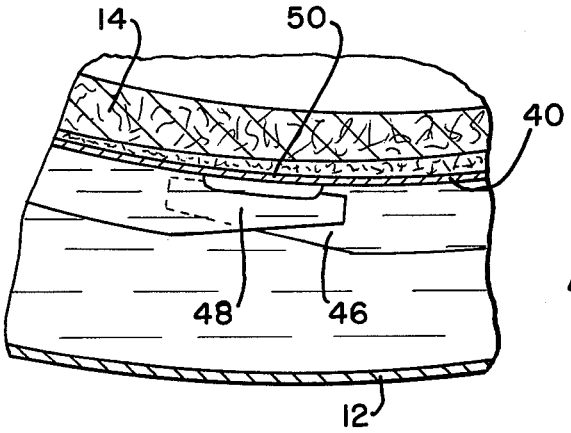
FIG. 2 is a front view on an enlarged scale showing the pivotal arrangement of the baffle in the area where the forming zone moves into the compaction zone.
Figure 3:
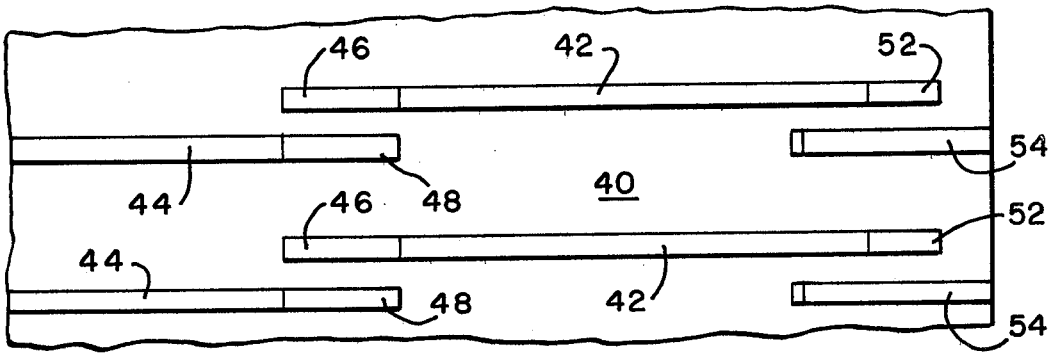
FIG. 3 is a bottom view of the baffle.
Figure 4:
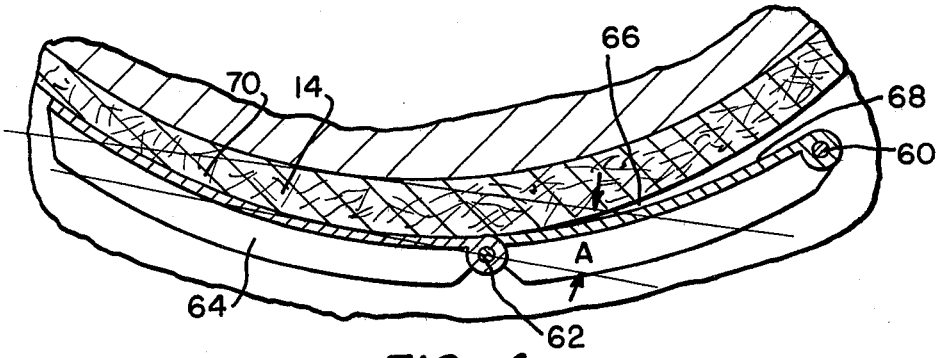
FIG. 4 is a front view on an enlarged scale showing a second embodiment of a baffle.
Figure 5:
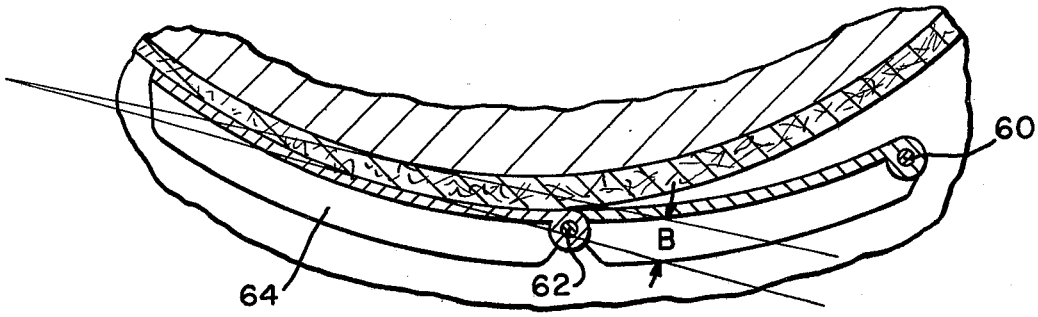
FIG. 5 is a view similar to FIG. 4 illustrating the automatic adjustment of the baffle in response to a change in mat thickness.

The baffle embodiment shown in FIG. 4 and FIG. 5 includes a longitudinal baffle which is pivotally connected to the vat by pivot pin 60. A pivotal connection is also formed by the pivot pin 62 in the area where the forming zone changes into the compaction zone. As with the embodiment of FIGS. 1 through 3, a plurality of actuators can be used to apply a compaction force against the ribs 64 of the pivotal baffles to automatically adjust the convergence angle for changes in mat thickness.

At the beginning of the compaction zone, the mat 14 has a very low consistency, especially near the baffle. This low consistency is less than 4% consistency. Therefore, the shear strength in the pulp mat is low. If the angle of convergence A (see FIG. 4) exceeds the drainage rate, the pressure in the area 66 between the mat 14 and the radial inside surface of the plate 68 will exceed the shear strength of the pulp mat and a reverse flow of liquid will occur. As we proceed towards the area 70, the consistency and shear strength in the pulp mat 14 will increase. If the angle of convergence exceeds the drainage rate at this point, a reverse flow is unlikely, but the pressure may rise so high as to tear the mat and the liquor is drained through gaps in the mat 14. This will, of course, cause the wash water to short circuit through the gaps as the disrupted mat enters the washing zone and proper displacement of the original liquor by washing cannot be achieved.

It can be shown mathematically that if the mat 14 should, because of various reasons such as increase in cylinder speed, change from the thickness shown in FIG. 4 to half the thickness such as shown in FIG. 5, in order to obtain proper drainage the convergence angle B of FIG. 5 must be half the convergence angle A of FIG. 4. Control of the convergence angle is through the proper locations of the force actuators. It can be shown mathematically that the center of gravity of the actuator force diagram is always in the same location, regardless of the type of pulp and mat thickness. Thus, with the actuators properly located, we will automatically get the same actuator force diagram and, hence, automatically obtain the correct convergence angle. The angle of convergence is defined as the angle between a tangent to the cylinder at the pivotal area where the forming zone approaches the compaction zone and a tangent to the radial inner surface of the baffle at the same pivotal area.

Though this invention has been described as a washer for washing the pulp obtained from a blow tank, the washer may also be used between the various chemical treating stages in a bleaching process. Also, though the washer has been described in general as a vacuum washer, a pressure other than a vacuum may be maintained on the inside of the cylinder 10, providing the inside pressure is less than the outside pressure.

I claim:

1. In a pressure pulp washer with a vat, a rotatable cylinder in the vat, a pulp inlet for feeding pulp slurry into the vat, means for maintaining a pressure inside the rotatable cylinder less than the pressure outside said cylinder to begin forming a pulp mat on the rotatable cylinder thereby providing a forming zone, and means for removing the pulp mat from the rotatable cylinder, the improvement comprising: a longitudinal baffle spaced from the rotatable cylinder, the baffle having a first pivot pivotally connecting the baffle to the vat at a point in the forming zone, said baffle also having a second pivot downstream from the first pivot and actuating means for applying an actuating force aginst the radial outside surface of the baffle, at a predetermined circumferential point downstream from the second pivot thereby providing a compaction zone downstream from the second pivot, said actuating means being positioned so that the baffle will automatically adjust in response to changes in thickness of the mat to provide the correct convergence angle.

2. The pressure pulp washer of claim 1 wherein: the baffle comprises a thin flexible plate with a plurality of circumferentially extending supporting ribs located on the outside of the thin flexible plate, said supporting ribs being positioned to permit the flexible plate to flex only at the two pivot points.

3. The pressure pulp washer of claim 1 wherein: the two pivot points are formed by pivot pins extending through pivot holes located at the two pivot points.

* * * * *